US008540797B2

(12) United States Patent
Raj et al.

(10) Patent No.: US 8,540,797 B2
(45) Date of Patent: Sep. 24, 2013

(54) PROCESS FOR PREPARATION OF NANO CERAMIC-METAL MATRIX COMPOSITES AND APPARATUS THEREOF

(75) Inventors: Rishi Raj, Boulder, CO (US); Mirle Krishnegowda Surappa, Karnataka (IN); Sudarshan, Karnataka (IN)

(73) Assignee: Indian Institute of Science, Karnataka (IN)

( * ) Notice: Subject to any disclaimer, the term of this patent is extended or adjusted under 35 U.S.C. 154(b) by 199 days.

(21) Appl. No.: 13/056,503

(22) PCT Filed: Jul. 29, 2008

(86) PCT No.: PCT/IB2008/001965

§ 371 (c)(1),
(2), (4) Date: May 12, 2011

(87) PCT Pub. No.: WO2010/013080

PCT Pub. Date: Feb. 4, 2010

(65) Prior Publication Data

US 2011/0315920 A1 Dec. 29, 2011

(51) Int. Cl.
*C22C 21/00* (2006.01)
*C22C 23/00* (2006.01)

(52) U.S. Cl.
USPC ..... 75/600; 75/604; 75/678; 75/684

(58) Field of Classification Search
USPC ..... 75/600, 603, 604, 663, 697, 701
See application file for complete search history.

(56) References Cited

U.S. PATENT DOCUMENTS

2006/0004169 A1* 1/2006 Sherwood et al. ..... 528/10
2006/0167147 A1 7/2006 Asgari

FOREIGN PATENT DOCUMENTS

EP 0559694 A1 9/1993
WO WO 92/09711 A1 6/1992

OTHER PUBLICATIONS

Hanumanth, GS et al., "Particle sedimentation during processing of liquid metal-matrix composites", 1992, Metallurgical Transactions B, 23(6):753-763.*

Hanumanth, GS et al. 1992 "Particle sedimentation during processing of liquid metal-matrix composites" *Metallurgical Transactions B* 23(6):753-763.

Janakiraman, N. et al. 2006 "Synthesis and phase evolution of Mg—Si—C—N ceramics prepared by pyrolysis of magnesium-filled poly(ureamethylvinyl)silazane precursor" *J. Materials Chemistry* 16:3844-3853.

Sudarshan et al. 2008 "Nanoceramic-Metal Matrix Composites by In-Situ Pyrolysis of Organic Precursors in a Liquid Melt" *Metallurgical and Materials Transactions A* 39:3291-3297.

* cited by examiner

*Primary Examiner* — Kaj K Olsen
*Assistant Examiner* — Jared Wood
(74) *Attorney, Agent, or Firm* — Knobbe, Martens, Olson & Bear, LLP

(57) ABSTRACT

A method to introduce ceramic particles into liquid metal through the polymeric precursor route by cross-linking organic precursor into a hard polymer, which is added to the liquid melt for in-situ pyrolysis of the organic into the ceramic phase. The starting material, the organic, for the above process can be in the form of a liquid or a solid. If it is a solid it is usually dissolved into a solvent to create a liquid form. The organic is then cross linked either directly by a thermal process, by adding a catalyst, or by the well known sol-gel process into a hard polymer. It is this hard polymer which is then pyrolyzed into a high temperature ceramic material by the process outlined above.

13 Claims, 1 Drawing Sheet

Figure 1:
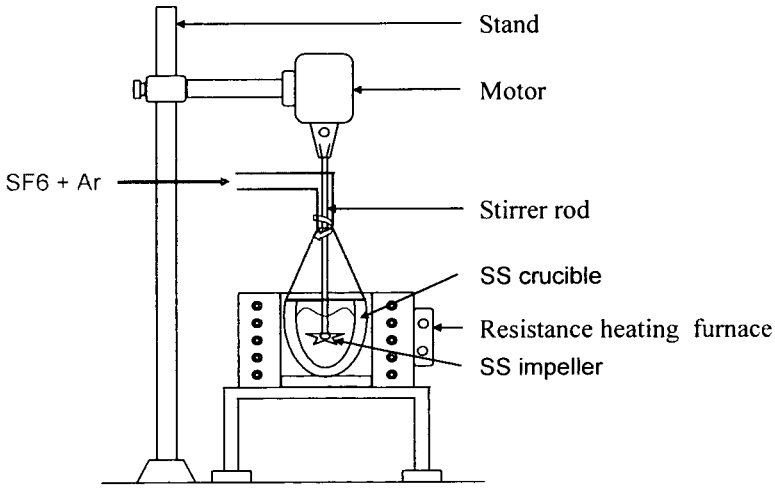

PROCESS FOR PREPARATION OF NANO CERAMIC-METAL MATRIX COMPOSITES AND APPARATUS THEREOF

FIELD OF THE INVENTION

"Melt-ceramic nano-composites made by in-situ pyrolysis of polymeric precursors in the liquid melt", Ex. Magnesium composites dispersed with nanoscale ceramic particles of silicon, carbon and nitrogen.

BACKGROUND OF THE INVENTION AND PRIOR ART

Metal-matrix composites, or MMCs, most commonly consist of aluminum alloys which are reinforced with particles of a hard ceramic phase, such as silicon carbide (SiC). These alloys have high elastic stiffness which is useful in applications such as brake-assemblies for automobiles. The MMCs are made by physically mixing particles of SiC into the molten metal. Several strategies for introducing the ceramic particles have been invented, but all of them use ceramic powders and the metal as the starting constituents for the fabrication of the MMCs.

Survey of prior art in this area reveals that there exist processes, which cover only production of nano-sized metal powder (US Patent Publication No. US20060167147A1) and the mixing of nano-sized powders of metal and ores in the solid state. There is no prior literature/patent on the production/fabrication of metal matrix composites involving solid-liquid interactions.

The principal limitation of these methods is the difficulty of incorporating ceramic particles of nanoscale dimensions (typically less than one thousand nanometers) into the melt. This limitation arises from the tendency of the ceramic particles of this size to agglomerate when in the powder form (nanoscale particles in a powder attract and bond to one another due to van der Waal's force, because this force increases highly nonlinearly with decreasing particle size). These agglomerates are difficult to break up into individual particles when added to the liquid metal. Without a uniform dispersion of the nanoscale particles, the benefit of creep resistance and good yield strength at elevated temperatures cannot be achieved. Aluminum and magnesium-based MMCs with a uniform nanoscale dispersion of the ceramic phase would be an enabling technology for the next generation automobile engines, jet engines, and other aerospace applications.

OBJECTS OF THE INVENTION

The primary object of the present invention is to provide a process to over come the aforesaid limitations.

Yet another object of the present invention is to introduce ceramic particles into the liquid metal through the polymeric route by an in-situ process.

Still another object of the present invention is to provide a new process which eliminates the multiple steps involved in first fabricating the ceramic particles and then, in a separate step, incorporating them into the liquid melt.

Still another object of the present invention is to produce a nanoscale dispersion of the ceramic into the liquid melt.

Still another object of the present invention is an apparatus to obtain melt-ceramic nano-composites made by in-situ pyrolysis of polymeric precursors in the liquid melt.

Still another object of the present invention is the liquid metal environment for the pyrolysis of the polymer which prevents the degradation of the organic and serves the same purpose as the inert environment used in the ex-situ process for making ceramics from the polymer.

STATEMENT OF THE INVENTION

The present invention relates to a process for the preparation of nano-ceramic metal-matrix composites, said process comprising the steps of cross-linking organic precursors to obtain organic polymers, inserting the organic polymers into a metal melt to produce a dispersion of organic polymers within the metal melt, and carrying out pyrolysis of said organic polymers by raising the metal melt temperature to a level where the polymer pyrolyzes in-situ into a ceramic phase to obtain the composites, and also an apparatus to introduce ceramic particles into the liquid metal from the polymeric precursor route by in-situ process, said apparatus comprises; motor connecting to stirrer rod for rotating the stirrer; the stirrer rod having impeller at the bottom to force a fluid in a desired direction, crucible partially surrounding the impeller for melting and calcining materials at high temperatures; and resistance heating furnace to maintain constant temperature during mixing.

BRIEF DESCRIPTION OF ACCOMPANYING DRAWINGS

FIG. 1 Schematic diagram of the stir casting set up used in fabrication of polymer derived ceramic (nanoparticle) metal-matrix composites.

Figure 2:
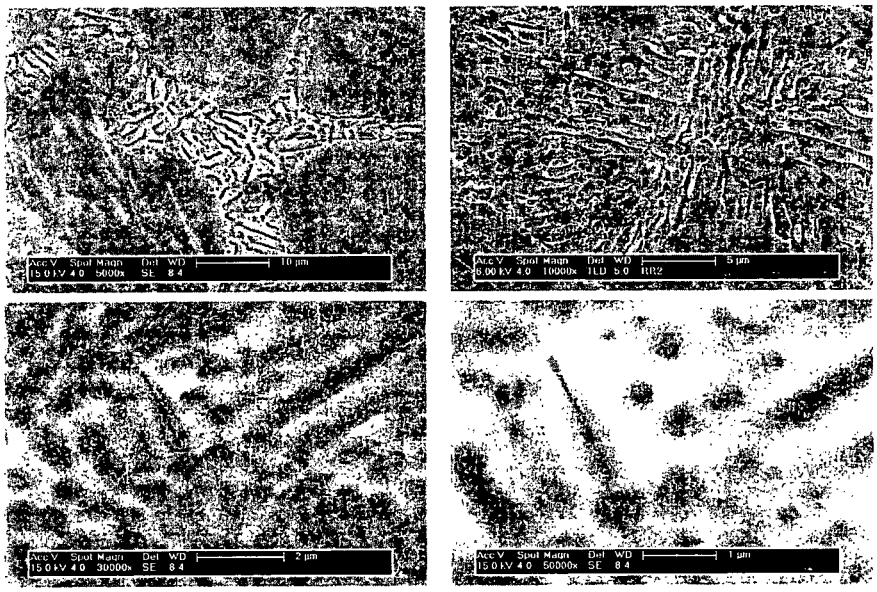

FIG. 2 Scanning Electron Micrograph of polymer derived nano-sized ceramic dispersed magnesium metal-matrix composites.

DETAILED DESCRIPTION OF THE INVENTION

The primary embodiment of the present invention is a process for preparation of nano-ceramic metal-matrix composites, said process comprising steps of cross-linking organic precursors to obtain rigid particles, inserting the rigid particles into a metal melt to produce a dispersion of ceramic particles; carrying out in-situ pyrolysis of produced ceramic particles by raising the metal melt temperature to a level where the polymer pyrolyzes in-situ into an amorphous phase to obtain the composites.

In yet another embodiment of the present invention, the organic precursors used in said method are in liquid or a solid form.

In still another embodiment of the instant invention, the organic precursor is cross-linked either directly by thermal process, by adding a catalyst, by sol-gel process into hard polymer or by any other well known conventional processes.

In still another embodiment of the instant invention, the polymer is pyrolyzed at high temperature ranging between 300° C. to 1000° C. to create ceramic material.

In still another embodiment of the instant invention, the pyrolysis is carried out in a controlled environment, usually an inert environment such as argon or nitrogen in order to preserve the desired chemical composition of an end product.

In still another embodiment of the instant invention, hydrogen released during pyrolysis from the polymer is flushed by bubbling nitrogen or argon through the melt.

In still another embodiment of the instant invention, the melting point of the metal is below the pyrolysis temperature and the pyrolysis process involves the removal of volatiles such as hydrogen, water vapor and in some instances alcohols and hydrocarbons in order to prevent fragmentation of the organic polymer.

In still another embodiment of the instant invention, the organic polymer is constituted of Si, O, C, N and combination thereof; and selected from the group consisting of polysilazanes, silsesquioxanes and mixtures thereof.

In still another embodiment of the instant invention, the cross-linked polymer powder added to the liquid melt ranges from 1% to 70% by volume.

In still another embodiment of the instant invention, the temperature of the melt mixture is raised to the pyrolysis temperature of the polymer preferably ranging from 800-1200° C., for a period of 1 h up to 8 h.

In still another embodiment of the instant invention, the organic polymer/organic phase is added in liquid form by injecting it directly into the liquid melt, where the external source of the organic liquid is held at ambient temperature.

In still another embodiment of the instant invention, the organic-polymer powder is added to facilitate mixing at a melt temperature of 660-800° C. for Mg, where the melt is protected by an argon gas purge.

The present invention also relates to an apparatus to introduce ceramic particles into the liquid metal through the polymeric precursor route by in-situ process, said apparatus comprises; motor connecting to stirrer rod for rotating the stirrer; the stirrer rod having impeller at the bottom to force a fluid in a desired direction, crucible partially surrounding the impeller for melting and calcining materials at high temperatures; and resistance heating furnace to maintain constant temperature during mixing.

In still another embodiment of the present invention, the temperature for melting and calcining is ranging between 300° C. to 1000° C.

The innovation in this disclosure is to introduce ceramic particles into liquid metal through the polymeric route by an in-situ process.

In the last two decades, ceramics such as various oxides, carbides and nitrides, are being prepared by the chemical route. In these processes, organic precursors are used to produce the ceramics directly by controlled pyrolysis of the organic. Examples of ceramics produced by this method include: various types of oxides by metalorganics, silicon carbides from carbosilanes, silicon oxycarbides from silsesquioxanes, and silicon nitride and silicon carbonitride from polysilazanes. The conversion of the organic into the ceramic occurs at temperatures ranging from 300° C. to 1000° C. The pyrolysis must be carried out in a controlled environment, usually an inert environment such as argon or nitrogen, in order to preserve the desired chemical composition of the end product. The pyrolysis process involves removal of volatiles such as hydrogen, water vapor and in some instances alcohols and hydrocarbons; therefore, in order to prevent fragmentation of the organic polymer the heating rate of the temperature cycle used for pyrolysis must be controlled.

The starting material, the organic, for the above process can be in the form of a liquid or a solid. If it is a solid, it is usually dissolved into a solvent to create a liquid form. The organic precursors are cross linked either directly by a thermal process, by adding a catalyst, or by the well known sol-gel process into a hard polymer. It is this hard polymer which is then pyrolyzed into a high temperature ceramic material by the process outlined above.

The basic premise of this invention is that the organic polymers should be pyrolyzed within the hot liquid metal to create an in-situ dispersion of nanoscale ceramic particles. In-situ pyrolysis has the following unique features, which cannot be obtained in the current practice of mixing ceramic particles into liquid metals for the fabrication of MMCs. These unique features are:

(A) The new process eliminates the multiple steps involved in first fabricating the ceramic particles and then, in a separate step, incorporating them into the liquid melt. The complexities of handling ceramic powders, especially very fine powders, are completely eliminated.

(B) Fragmentation of the organic precursor during pyrolysis is an asset in the invented process since its aim is to produce a nanoscale dispersion of the ceramic into the liquid melt. The extent of fragmentation is controlled by changing the feed rate of the organic into the liquid melt, the temperature of the melt, and by injecting an inert carrier gas along with the organic in the injection process.

(C) The liquid metal environment for the pyrolysis of the polymer prevents the degradation of the organic and serves the same purpose as the inert environment used in the ex-situ process for making ceramics from the polymer. Furthermore there can be beneficial reactions between the liquid metal and the organic precursors for producing hard phases of intermetallics which may further enhance the high temperature mechanical properties of the MMC.

The in-situ dispersion of the ceramic can be achieved by following method. Firstly, the organic is first cross-linked into a hard polymer, this powder is crushed, and then added to the liquid melt for in-situ pyrolysis of the organic into the ceramic phase.

FIG. 1 shows schematic set-up used for mixing ores linked powders of polysilazane precursor (Ceraset™) in liquid magnesium metal and pyrolyzed in-situ.

The process of the invention is particularly suitable for aluminum and magnesium alloys because of their relatively low melting points. For example the process above can only be used when the melting point is below the pyrolysis temperature; aluminum and magnesium alloys meet this requirement.

TABLE I

High temperature mechanical data of constant-load compression creep tests @ 20 MPa

| Material | Temp. (K) | Initial stress (MPa) | True strain (%) | Time (sec) | Strain rate at 11% strain ($s^{-1}$) |
|---|---|---|---|---|---|
| Pure Mg | 723 | 20 | 20 | 7.8 | 1.8 |
| Mg + 5% Ceraset Composite | 723 | 20 | 20 | 84 | $2.0 \times 10^{-1}$ |

In this instance, the ceramic particles are expected to be constituted from silicon, carbon, nitrogen and oxygen. Some intermetallics may also have formed by reaction with the liquid melt. FIG. 2 shows SEM micrograph of 5% nanoparticle dispersed magnesium matrix composite. Composites thus produced possess improved hardness and excellent creep properties compared to unreinforced magnesium (Table 1).

The examples which are explained in the present invention is not limiting to the scope of the invention.

The invention claimed is:

1. A process for preparation of nano-ceramic metal-matrix composites, said process comprising steps of cross-linking organic precursors to obtain organic polymers, inserting the organic polymers into a metal melt to produce a dispersion of organic polymers within the metal melt; carrying out pyrolysis of said organic polymers by raising the metal melt temperature to a level where the polymer pyrolyzes in-situ into a ceramic phase.

2. The process as claimed in claim 1, wherein the organic precursors used in said method are in liquid or a solid form.

3. The method as claimed in claim 1, wherein the organic precursor is cross-linked by thermal process by adding a catalyst, by sol-gel process or by other conventional processes.

4. The method as claimed in claim 1, wherein the polymer is pyrolyzed at high temperature ranging between 300° C. to 1000° C.

5. The method as claimed in claim 1, wherein the pyrolysis is carried out in a controlled environment, wherein the controlled environment is an inert environment containing argon or nitrogen in order to preserve the desired chemical composition of an end product.

6. The process as claimed in claim 1, wherein hydrogen released during pyrolysis from of the polymer is flushed by bubbling nitrogen or argon through the melt.

7. The method as claimed in claim 1, wherein the melting point of the metal is below the pyrolysis temperature.

8. The process as claimed in claim 1, wherein the organic-polymer comprises elements selected from the group consisting of Si, O, C, N and a combination thereof, and wherein the organic polymer is selected from the group consisting of polysilazanes, silsesquioxanes and mixtures thereof.

9. The process as claimed in claim 1, wherein the cross-linked polymer added to the liquid melt ranges from 1% to 70% by volume with respect to the metal.

10. The process as claimed in claim 1, wherein the temperature is raised to the pyrolysis temperature of the polymer ranging from 800-1200° C., for a period of 1 h up to 8 h.

11. The process as claimed in claim 1, wherein the organic polymer is added in liquid form by injecting it directly into the liquid melt.

12. The process as claimed in claim 1, wherein said process is employed to produce nanoscale ceramic composites of aluminum matrices, where the intermetallic and ceramic phases created by said process consist of Al, Mg, Si, N, C and O.

13. The process as claimed in claim 1, wherein the organic-polymer is added to facilitate mixing at a melt temperature of 660-800° C. for Mg, where the melt is protected by an argon gas purge.

* * * * *